US006202878B1

(12) United States Patent
Cook

(10) Patent No.: US 6,202,878 B1
(45) Date of Patent: Mar. 20, 2001

(54) CLOSURES

(75) Inventor: Charles David Cook, Hemel Hempstead (GB)

(73) Assignee: Chromacol Limited, Hertfordshire (GB)

( * ) Notice: Subject to any disclaimer, the term of this patent is extended or adjusted under 35 U.S.C. 154(b) by 0 days.

(21) Appl. No.: 09/260,152

(22) Filed: Mar. 1, 1999

(30) Foreign Application Priority Data

Mar. 3, 1998 (GB) ..... 9804383

(51) Int. Cl.[7] ..... B65D 3/24; B65D 39/04

(52) U.S. Cl. ..... 220/255; 215/247; 215/364; 215/DIG. 3; 215/355; 220/507; 220/526; 220/7

(58) Field of Search ..... 215/355, 6, 354, 215/247, 364, DIG. 3; 220/507, 523, 526, 253; 422/916, 942, 300, 99; 435/288.4, 305.3, 305.2

(56) References Cited

U.S. PATENT DOCUMENTS

| | | | | |
|---|---|---|---|---|
| 4,773,552 | * | 9/1988 | Boege et al. | 215/247 |
| 4,960,219 | | 10/1990 | Jordan . | |
| 5,071,331 | * | 12/1991 | Falco | 425/4 R |
| 5,538,134 | * | 7/1996 | Pitesky | 206/438 |
| 5,632,396 | | 5/1997 | Burns . | |
| 5,720,406 | | 2/1998 | Gassbind . | |

FOREIGN PATENT DOCUMENTS

| | | |
|---|---|---|
| 0285496 A1 | 10/1988 | (EP) . |
| 0450096 A1 | 10/1991 | (EP) . |
| 0642828 A1 | 3/1995 | (EP) . |
| 2322121 | 8/1998 | (GB) . |
| WO 93/01739 | 2/1993 | (WO) . |

* cited by examiner

*Primary Examiner*—Allan N. Shoap
*Assistant Examiner*—Niki M. Eloshway
(74) *Attorney, Agent, or Firm*—John F. Salazar; Thomas B. McGurk; Middleton Reutlinger

(57) ABSTRACT

A closure apparatus is provided that includes a plurality of plug closures interconnected by straps. Each plug includes a blind bore therein into which a sampling needle may be inserted for penetration of the plug in order to extract a sample from the container to which the plug is attached. The plugs are arranged within an array that may correspond to an array of containers set within wells located in a block array. A membrane is also provided that interconnects the straps and the plugs. The plugs are fashioned from an elastomer such as a silicone elastomer. A layer of PTFE is provided on the bottom outer surface of the plugs and may also be included on the underside of the interconnecting straps and membrane, so as to provide an inert barrier in contact with the contents of the containers.

1 Claim, 4 Drawing Sheets

CLOSURES

BACKGROUND OF THE INVENTION

In fields such as combinatorial chemistry and autosampling, it is well known for a large number of containers or vessels to be held in a regular array of rows and columns or in concentric circles.

In life science chemistry, for example, it is known to use a moulded block formed with an array of wells, each well forming a container for a different combination of chemicals. It is known to provide a lid for such a block which is in the form of a fairly stiff mat formed with an array of plugs for closing the wells. The blocks are usually moulded from plastic material but in combinational chemistry where the chemicals being analysed are often incompatible with this (such as when organic solvents are involved), it has been proposed to form the block from glass, or to provide a glass vial as a liner to each well. In the latter solution, each glass vial is provided with its own separate cap (which may be a crimp cap or a snap-fitting cap) which must be individually fitted to the vial. When a needle is inserted through the cap to remove a sample from the vial, it is gripped by the cap and the vial tends to be withdrawn from the block when the needle is being removed.

SUMMARY OF THE INVENTION

The invention sets out to provide an improved closure means for such an array of containers.

According to the invention, there is provided closure means for a plurality of containers in an array comprising a plurality of container closures in a corresponding array with each closure connected to adjacent closures and being formed as a plug for insertion into a corresponding container and having a blind bore for the penetration of a sampling needle through the plug.

BRIEF DESCRIPTION OF THE DRAWINGS

Embodiments of the invention are described below with reference to the accompanying drawings, in which.

DESCRIPTION OF THE PREFERRED EMBODIMENT

Figure 1:
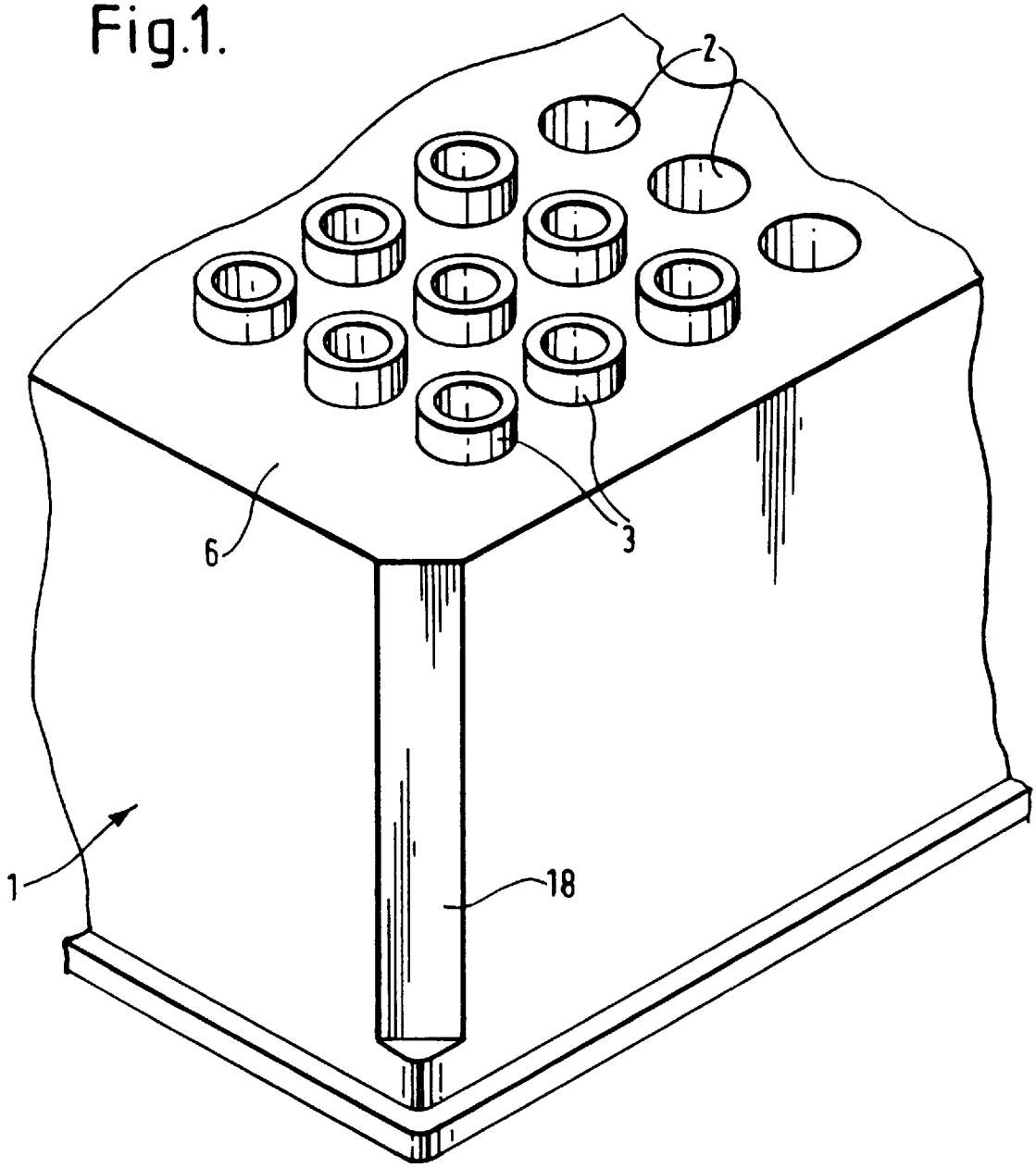
FIG. 1 is a partial view of a well block with vials inserted into some of the wells.

One corner of a moulded well block 1 is shown in FIG. 1. The block is provided with an array of wells 2 regularly spaced in rows and columns. Only some of the wells are shown in FIG. 1 as having containers in the form of glass vials 3 located therein although, in general, all the wells will contain a vial. Part of the head of each vial 3 can be seen to protrude from its well 2 in FIG. 1. A typical block will comprise 24, 96, 384 or 1536 wells in an array of rows and column in multiples of 8 and 12.

Figure 2:
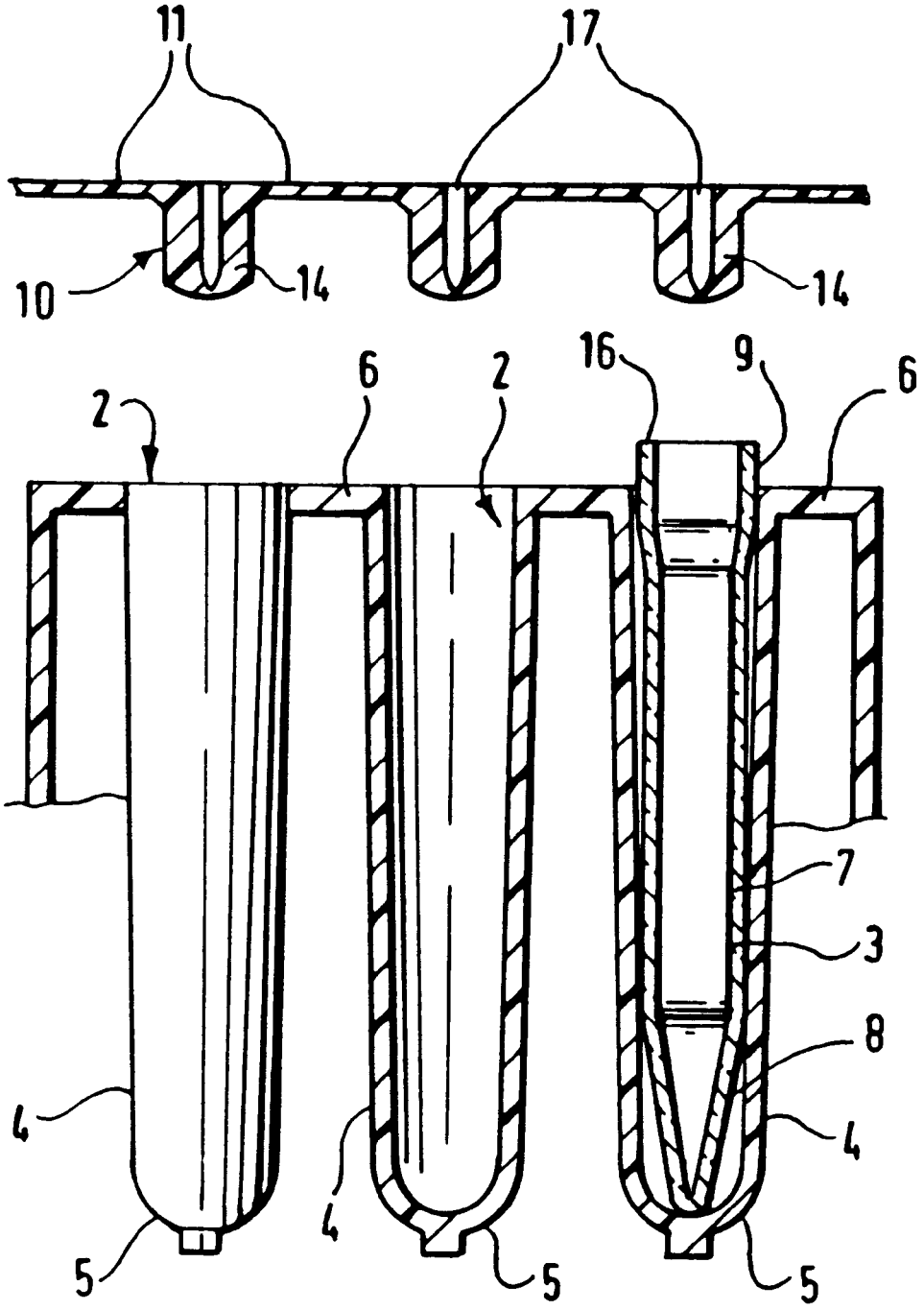
FIG. 2 is a partial vertical cross-section through well block and a sheet of closures.

FIG. 2 shows a cross-section through three wells of the block. As can be seen, each well 2 is formed as a slightly tapering tube 4 with a closed bottom 5 and an open top. The tubes 4 are connected together by the upper wall 6 of the block.

A vial 3 is shown in one of the wells 2 and has a generally cylindrical main body part 7 a tapered bottom 8 and a slightly enlarged head 9 which helps the vial locate snugly in the upper end of the well. The provision of the head 9 allows the overall depth of the wells to vary slightly without interfering with the snug fit of the vials. In the case of the vial shown, the head is not so enlarged as to permit a crimped cap to be fitted thereto.

Figure 3:
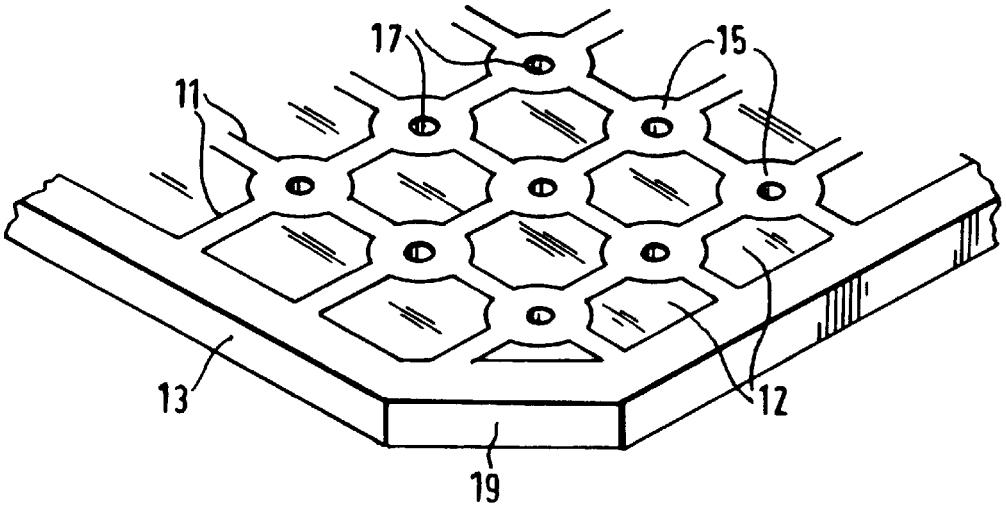
FIG. 3 is a partial view from above of a sheet of closures.
Figure 4:
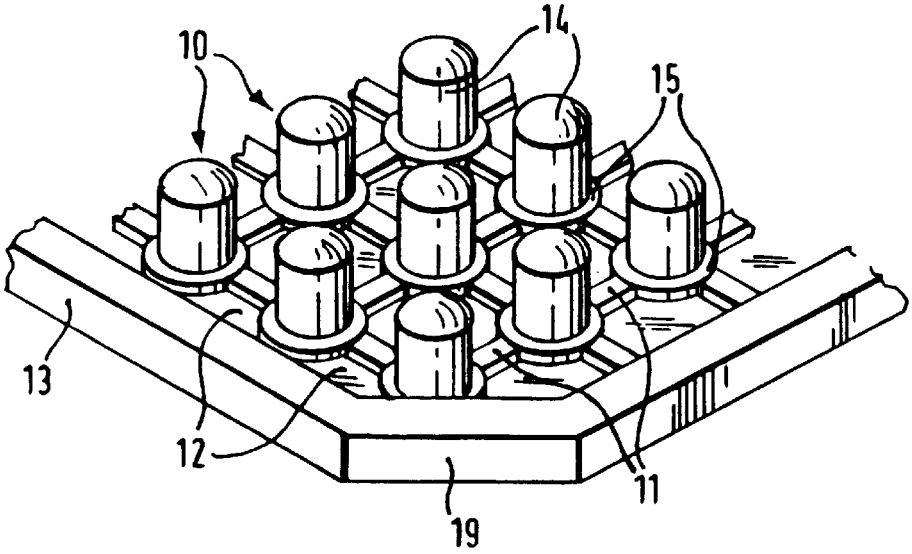
FIG. 4 is a partial view from below of a sheet of closures.

A closure means for closing all the vials held in the block is partly shown in FIGS. 2, 3 and 4 and comprises a plurality of container closures 10 in an array corresponding to that of the wells and vials. The individual closures are connected to each other by connection means provided by connecting straps 11 and a very thin membrane 12 to form a sheet or web of closures which is moulded as a single piece with a relatively thick outer boundary wall 13 which helps keep it in shape. The straps 11 are in the form of thin strips which can be easily cut with a knife etc or snipped through with scissors. The straps serve to keep the plugs correctly positioned relative to one another.

Figure 5:
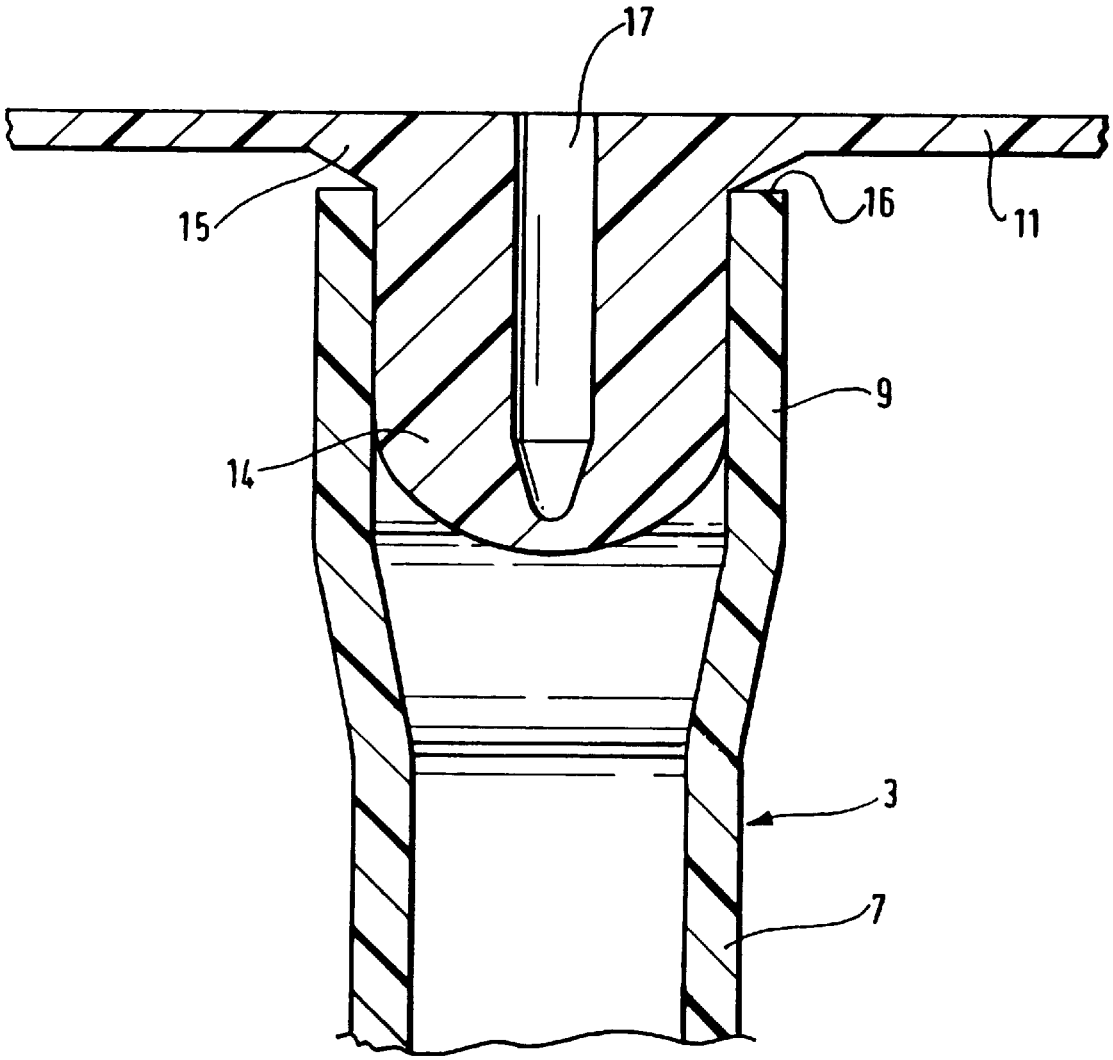
FIG. 5 is a vertical cross-section through a closure in the top of a vial on an enlarged scale.

As can be seen in FIGS. 2, 4 and 5, the closures 10 are in the form of plugs which are a push fit into the heads of the vials and consist of a lower cylindrical portion 14 which fits into the open end of a vial and an upper cylindrical portion 15 which has a greater outer diameter than the lower portion 14 and overlies the upper end wall 16 of the vial.

The central blind bore 17 in the plug is provided for the penetration of a sampling needle through the plug. The plug may be made of a number of materials according to the application, such as silicone elastomer, natural or synthetic rubber, polyethylene and polypropylene. A thin protective layer (not shown) of PTFE or other inert material is provided on the outer surface of the plug on the underside of the sheet to prevent reaction between the plug and the contents of the vial. In practice, a thin sheet of PTFE is put into the mould with the sheet of silicone elastomer or other material which is used to form the web. Thus, the whole under surface of the sheet is covered by a thin coating of PTFE and the membrane 12 is largely formed thereby.

Although described in combination with a well block carrying glass vials, the closure means may be used in any application where a plurality of containers are held in an array, such as for example in autosampling. The closure means might also be used with a block of wells not provided with vial inserts. In this case, the plugs would fit directly into the wells 2.

The sheet of closures can be fitted to an array of containers purely by hand or with the use of mechanical assistance. Samples can be taken from any one of the vials by inserting a needle through the plug via the blind bore 17. Although the needle will be slightly gripped as it is withdrawn, the plug will be retained in position by virtue of its connection to the rest of the sheet of closures. When it is required to remove any individual container, this can be readily achieved by snipping through the straps and membrane connecting the selected closure. The container and its closure can then be removed from the array without affecting any of the other containers in the array. A tool having an annular cutting edge may be provided for this purpose.

The block 1 and the sheet of closures are each provided with cut-away corners 18, 19 to assist in registration.

The sheet will normally be provided with an array of rows and columns corresponding to those of the block but as an alternative may be formed as a strip of one or more rows so that each sheet will cover only part of a block.

The membrane 12 may assist when it is required to move all the vials from one block to another. In this case, a flat platen can be applied to the upper surface of the web and a vacuum applied through the platen to the membrane for lifting the web and all its associated vials from the block and transporting them to an alternative block.

What is claimed is:

1. A closure apparatus comprising:

a plurality of closure plugs interconnected by a plurality of straps, said plurality of straps and said plurality of closure plugs forming a latticework, each said closure plug including a central blind bore having a cylindrical sidewall and a conical closed end, said plurality of closure plugs and said plurality of straps being formed of a silicone elastomer, said plurality of closure plugs and said plurality of straps including a layer of PTFE provided thereon; and, a membrane interconnecting said straps and said plugs, said membrane including an outer layer of PTFE, said membrane and said plurality of closure plugs and said plurality of straps forming a web, said web circumscribed by a silicone elastomeric frame.

* * * * *